US010060064B2

(12) United States Patent
Lv et al.

(10) Patent No.: US 10,060,064 B2
(45) Date of Patent: Aug. 28, 2018

(54) ATTACHED BLOCK STRUCTURE FOR INNER BARREL OF WASHING MACHINE

(71) Applicants: HAIER GROUP CORPORATION, Shangdong (CN); QINGDAO HAIER WASHING MACHINE CO., LTD., Shangdong (CN)

(72) Inventors: Peishi Lv, Shandong (CN); Lin Yang, Shandong (CN); Yunlong Tian, Shandong (CN); Lingchen Wang, Shandong (CN); Zunan Liu, Shandong (CN); Qinglong Ji, Shandong (CN)

(73) Assignees: HAIER GROUP CORPORATION, Shandong (CN); OINGDAO HAIER WASHING MACHINE CO., LTD., Shandong (CN)

( * ) Notice: Subject to any disclaimer, the term of this patent is extended or adjusted under 35 U.S.C. 154(b) by 0 days.

(21) Appl. No.: 15/127,571

(22) PCT Filed: Nov. 28, 2014

(86) PCT No.: PCT/CN2014/092481

§ 371 (c)(1),
(2) Date: Sep. 20, 2016

(87) PCT Pub. No.: WO2015/143887

PCT Pub. Date: Oct. 1, 2015

(65) Prior Publication Data

US 2017/0260676 A1 Sep. 14, 2017

(30) Foreign Application Priority Data

Mar. 24, 2014 (CN) ..... 2014 1 0111476

(51) Int. Cl.
*D06F 37/06* (2006.01)
*D06F 37/14* (2006.01)
(Continued)

(52) U.S. Cl.
CPC ..... *D06F 37/06* (2013.01); *D06F 37/065* (2013.01); *D06F 37/14* (2013.01); *D06F 37/145* (2013.01);
(Continued)

(58) Field of Classification Search
CPC ..... D06F 37/06; D06F 37/065; D06F 37/14; D06F 37/145; D06F 37/26; D06F 37/264; D06F 39/12
(Continued)

(56) References Cited

U.S. PATENT DOCUMENTS

2005/0204783 A1* 9/2005 Kim ..... D06F 37/06 68/3 R
2007/0017259 A1* 1/2007 Cho ..... D06F 37/06 68/3 R

FOREIGN PATENT DOCUMENTS

CN 2617801 Y 5/2004
CN 201933313 U 8/2011
(Continued)

OTHER PUBLICATIONS

Pan et al., "CN103306100A English Machine Translation.pdf", Sep. 18, 2013—Machine translation from Espacenet.com.*
(Continued)

*Primary Examiner* — Levon J Shahinian
(74) *Attorney, Agent, or Firm* — Marshall, Gerstein & Borun LLP

(57) ABSTRACT

The present invention relates to an attached block structure for an inner barrel of a washing machine. The attached block structure is of a thin wall structure, which is installed on an inner wall of the inner barrel of the washing machine, a series of bulge structures (1) are arranged on one side of the thin wall structure facing interior of the inner barrel of the washing machine, and the bulge structures (1) are distrib-
(Continued)

uted along curves. The attached block structure for the inner barrel of the washing machine increases the rolling strength of washing water; and meanwhile, the bulge structures (1) additionally arranged on the attached block structure can not only realize a better rubbing and kneading effect on clothes, but also realize a certain three-dimensional water flow effect, thereby improving the washing cleanness, and having better user experience.

8 Claims, 3 Drawing Sheets

(51) Int. Cl.
*D06F 37/26* (2006.01)
*D06F 39/12* (2006.01)

(52) U.S. Cl.
CPC ..... *D06F 37/26* (2013.01); *D06F 37/264* (2013.01); *D06F 39/12* (2013.01)

(58) Field of Classification Search
USPC ..... 68/139, 140, 142, 212, 237
See application file for complete search history.

(56) References Cited

FOREIGN PATENT DOCUMENTS

| | | | |
|---|---|---|---|
| CN | 103114418 | A | 5/2013 |
| CN | 103306100 | A | 9/2013 |
| CN | 203174363 | U | 9/2013 |
| CN | 203383018 | U | 1/2014 |
| JP | 2001340694 | A | 12/2001 |
| JP | 2005348943 | A | 12/2005 |

OTHER PUBLICATIONS

International Search Report for Application No. PCT/CN2014/092481, dated Mar. 3, 2015.

* cited by examiner

ATTACHED BLOCK STRUCTURE FOR INNER BARREL OF WASHING MACHINE

TECHNICAL FIELD

The present disclosure relates to the field of washing machines, in particular to an attached block structure for an inner barrel of a washing machine.

BACKGROUND

The existing washing machine generally consists of a washing drum, a driving device and a controlling device, wherein the washing drum includes an inner barrel; and when in use, clothes are placed into the inner barrel, washing liquid is driven by the driving device to form rotational flow, and the rotational flow applies impacts on the clothes, thereby washing or rinsing the clothes. Cleanness of the clothes is influenced by rolling strength of the water flow; in order to increase the cleanness, the wall of inner barrel of the existing washing machine is always provided with ribs integrally formed in an injection molding manner or a pressure casting manner, the height and the shape of such ribs are generally relatively singularized, the rolling strength of the formed water flow and the clothes is relatively small, and the effect on increasing the cleanness is not significant.

The existing utility model patent with the Chinese patent application No. 02213872.2 relates to an inner barrel of a washing machine and an inner barrel accessory including an attached block, the attached block is of a streamline-shape cavity thin wall which is provided with an installation part, the attached block is installed on the wall of the inner barrel through screws, and the upper end of the attached block is close to the top of the inner barrel. Therefore, the attached block is driven by the rotation of the inner barrel to continuously stir the clothes, participating in washing, and the clothes roll over and are not intertwined, thereby increasing the rolling strength of the water flow, and facilitating an increase of the cleanness of the clothes.

A further utility model patent with the Chinese patent application No. 02213885.4 relates to an inner barrel of a washing machine, which includes an attached block, the attached block is of a streamline-shape cavity thin wall which is provided with an installation part, the attached block is installed on the wall of the inner barrel through screws, and the upper end of the attached block is close to the top of the inner barrel. Therefore, the attached block is driven by the rotation of the inner barrel to continuously stir the clothes, participating in washing, and the clothes roll over and are not intertwined, thereby increasing the rolling strength of the water flow, and facilitating an increase of the cleanness of the clothes.

According to the above two patents, the rolling strength of the water flow is increased by adding the attached block on the inner barrel of the washing machine. Although the existing technical problems are solved, the frictional damage of the added attached block on the clothes is relatively severe, moreover, the flowing direction of the formed rolling water flow is single, thus the washing effect is not apparently improved, and the use experience is not facilitated.

SUMMARY

An object of the present disclosure is to provide an attached block structure for an inner barrel of a washing machine, being capable of increasing the rolling strength of the washing water and also capable of forming a certain three-dimensional water flow effect, thereby improving the washing cleanness.

In order to achieve the above-mentioned object, the present disclosure uses technical solutions as follows:

An attached block structure for an inner barrel of a washing machine is provided, wherein the attached block structure is of a thin wall structure, which is installed on an inner wall of the inner barrel of the washing machine; a series of bulge structures are arranged on one side of the thin wall structure facing interior of the inner barrel of the washing machine, and the bulge structures are distributed along curves.

Further, an upper part of the thin wall structure is installed near a top of the inner barrel, and a lower part of the thin wall structure is installed near a junction between a bottom of the inner barrel and a drum body.

Further, the thin wall structure is in a rectangular shape as a whole, a width is ⅕-⅔ of a length of the thin wall structure, and a thickness is 1/20-⅕ of the length of the thin wall structure; and a cross section of the thin wall structure is in an arc shape, and a lengthwise section of the thin wall structure is in a streamline shape.

Further, the bulge structures and the thin wall structure are integrally injection-molded, and each bulge structure is in a hemispherical shape.

Further, the bulge structures are symmetrically distributed about a center of the thin wall structure.

Further, the distribution curves of the bulge structures include a hyperbolic curve and a sine curve, and the hyperbolic curve is disposed at two sides of the sine curve.

Further, the sine curve is arranged along a diagonal line of the thin wall structure; a focal point of the hyperbolic curve is disposed on an X axis, one branch of the hyperbolic curve in −X axis direction is arranged at a left side of the sine curve, the other branch of the hyperbolic curve in +X axis direction is arranged at a right side of the sine curve, and an asymptotic line of the hyperbolic curve is the diagonal line of the thin wall structure provided with the sine curve.

Further, the quantity of the bulge structures is 10 to 30 and preferably 15 to 20; and the bulge structures are respectively distributed along the hyperbolic curve and the sine curve.

Further, the bulge structures are installed on the inner wall of the inner barrel of the washing machine by screws, a back of the thin wall structure is provided with screw studs for installing the screws, and an anti-shrinkage structure of each screw stud is concealed in the corresponding bulge structure.

Further, the thin wall structure and the inner barrel of the washing machine are seamlessly installed.

The present disclosure provides a novel attached block structure for an inner barrel of a washing machine, thereby increasing the rolling strength of the washing water; and meanwhile, the bulge structures additionally arranged on the attached block structure can not only realize a better rubbing and kneading effect on the clothes, but also realize a certain three-dimensional water flow effect, thereby improving the washing cleanness, and having better user experience.

By using the above-mentioned technical solutions, the present disclosure has the beneficial effects as follows:

1. The thin wall structure of the present disclosure is in a rectangular shape as a whole, the width is ⅕-⅔ of the length of the thin wall structure, and the thickness is 1/20-⅕ of the length of the thin wall structure; and the cross section of the thin wall structure is in an arc shape, and the lengthwise section of the thin wall structure is in a streamline shape. Compared with the existing attached block structure for the inner barrel of the washing machine, the attached block structure of the present disclosure with such structural sizes has a larger surface area but smaller thickness, thereby alleviating wear of the clothes during the washing.

2. A series of bulge structures are arranged on one side of the thin wall structure facing the interior of the inner barrel of the washing machine in the present disclosure, and the bulge structures can be in contact friction with the clothes, thereby improving the washing cleanness of the clothes; and moreover, the bulge structures are arranged dispersedly along the curves, thereby preventing the damage by large-area friction on the clothes due to excessively large contact area with the clothes.

3. The bulge structures of the present disclosure are arranged along the curves, a motion track of the water flow flowing regularly in a clockwise or a counterclockwise direction during washing is changed under a collective effect of the attached block structure and the bulge structures, thereby increasing the rolling strength of the water flow, and achieving the certain three-dimensional water flow effect.

4. The anti-shrinkage structure of each screw stud for installing the screw is arranged inside the bulge structure, thereby not only playing a role in well preventing the shrinkage of the screw stud, but also maintaining the overall completeness and aesthetics of an appearance of the attached block structure.

Figure 1:
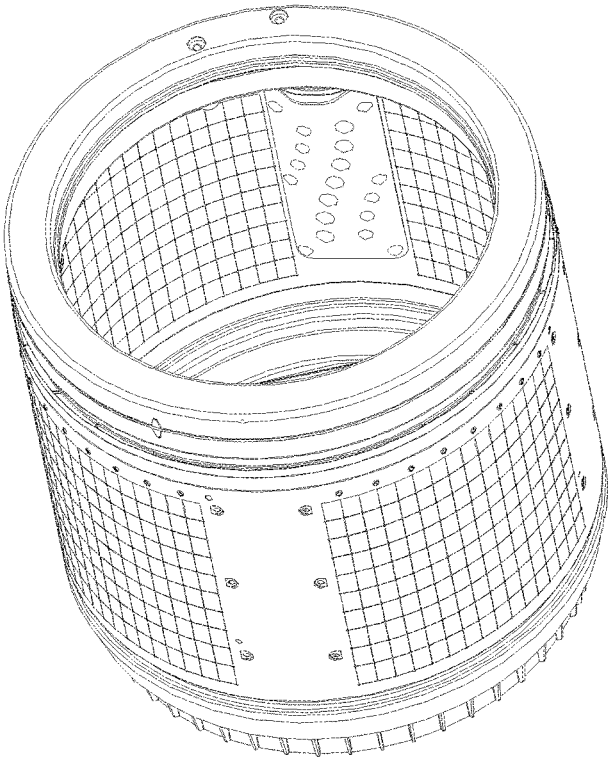
FIG. 1 is an installation schematic diagram showing an attached block structure installed on an inner barrel of a washing machine in the present disclosure.

Reference numerals are listed. 1: bulge structure; 2: screw stud.

DETAILED DESCRIPTION

An attached block structure for an inner barrel of a washing machine is described below in detail with reference to the attached drawings.

Figure 2:
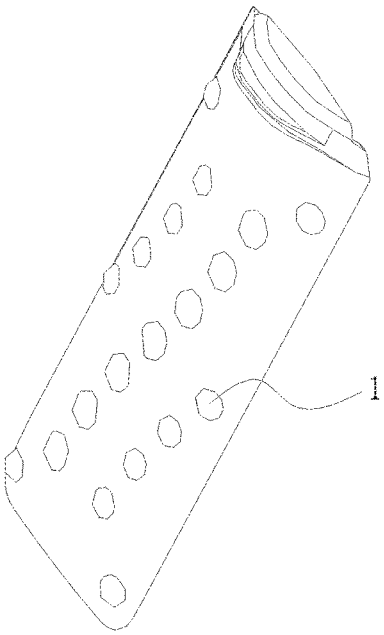
FIG. 2 is a three-dimensional structural schematic diagram of the present disclosure.
Figure 3:
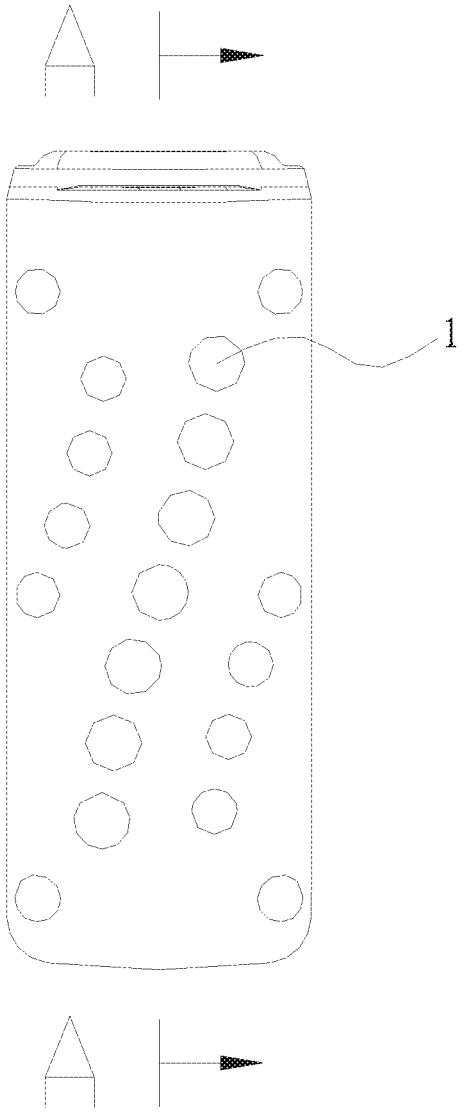
FIG. 3 is a front view of the present disclosure.
Figure 4:
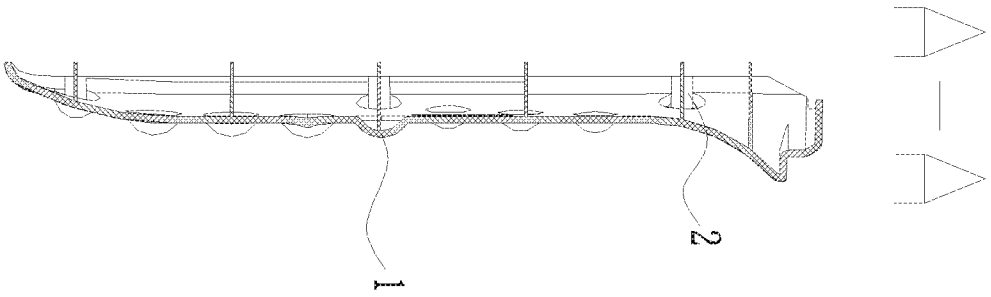
FIG. 4 is a section view along an A-A plane of the front view of the present disclosure.

As shown in FIGS. 1, 2, 3 and 4, the attached block structure for the inner barrel of the washing machine is of a thin wall structure, which is installed on an inner wall of the inner barrel of the washing machine, a series of bulge structures 1 are arranged on one side of the thin wall structure facing interior of the inner barrel of the washing machine, and the bulge structures 1 are distributed along curves.

The main function of the attached block structure is to increase rolling strength of the water flow, so the installation and the specific size and shape of the attached block structure for the inner barrel are very important. In order to increase the rolling strength of the washing water in the inner barrel of the washing machine from top to bottom, an upper part of the thin wall structure of the present disclosure is installed near a top of the inner barrel, and a lower part of the thin wall structure is installed near the junction between a bottom of the inner barrel and a drum body.

Meanwhile, the existing attached block structure for the inner barrel of the washing machine has disadvantages on the following two aspects: firstly, the extension of the attached block structure towards the inner barrel of the washing machine is excessively large, resulting in relatively large obstruction and friction on the clothes during the washing, so although the rolling strength of the washing water is increased and the cleanness of the clothes is improved, wear of the clothes is relatively severe; and secondly, the extension of the attached block structure towards the inner barrel of the washing machine is excessively small, so an effect on increasing the rolling strength of the washing water cannot be well achieved. In order to overcome the above-mentioned two disadvantages, the thin wall structure of the attached block structure is in a rectangular shape as a whole, the width is ⅕-⅔ of the length of the thin wall structure, and the thickness is 1/20-⅕ of the length of the thin wall structure; and the cross section of the thin wall structure is in an arc shape, and the lengthwise section of the thin wall structure is in a streamline shape. The external surface area of the overall size of the attached block structure in the present disclosure is larger than that of the existing attached block structure, thereby prolonging the action time of the washing water flow; although the thickness of the attached block structure is relatively small, due to the bulge structures on the outer surface of the thin wall structure, the interaction effect with the washing water flow is improved and the frictional effect with the clothes is increased, thereby enhancing the washing cleanness of the clothes; and the scattered arrangement of the bulge structures can prevent wear of the clothes in a large area, thereby better protecting the clothes.

The attached block structure of the present disclosure is formed in one step by means of an injection molding process; in order to simplify the manufacturing process, the bulge structures 1 and the thin wall structure are integrally injection-molded; the specific shape of the bulge structure can be designed; the bulge structure can be designed as a cuboid block, an elliptic block or other irregular three-dimensional structures; and preferably, each bulge structure 1 in the present disclosure is in a hemispherical shape, which can play a role in better guiding the water flow and also can prevent the clothes from being hooked and damaged.

In order to solve the technical problems in the existing art, the bulge structures 1 are creatively arranged along the curves, so the specific arrangement of the bulge structures 1 can greatly influence the technical effect of the present disclosure.

The water flow in the inner barrel of the washing machine continuously rotates in the clockwise direction and in the counterclockwise direction when washing the clothes, so the attached block structure of the present disclosure shall be able to act on the washing water in the two directions; and the bulge structures 1 are symmetrically distributed about a center of the thin wall structure, thus the bulge structures can perform the same effect on the water flow in the clockwise direction and in the counterclockwise direction.

By analyzing the flowing direction and the acting force of the washing water flow in the washing process, the specific arrangement of the bulge structures on the thin wall structure can change the flowing direction of the water flow, so the distribution curves of the bulge structures 1 include a hyperbolic curve and a sine curve, and the hyperbolic curve is disposed at two sides of the sine curve.

Specifically, the sine curve is arranged along a diagonal line of the thin wall structure; a focal point of the hyperbolic curve is disposed on an X axis, one branch of the hyperbolic curve in −X axis direction is arranged at the left side of the sine curve, the other branch of the hyperbolic curve in +X axis direction is arranged at the right side of the sine curve, and an asymptotic line of the hyperbolic curve is the diagonal line of the thin wall structure provided with the sine curve. By means of such arrangement, when the water flow rotates in the clockwise direction and in the counterclockwise direction, the directions of the acting force of the bulge structures 1 on the water flow are different; and moreover, the attached block structures of the present disclosure are generally symmetrically installed at two sides of the inner barrel of the washing machine, so the effects of the two attached block structures on the water flow are different, and a three-dimensional water flow can be formed in a certain range. Therefore, the attached block structure of the present disclosure can not only increase the rolling strength of the water flow, but also obtain the three-dimensional water flow, thereby improving the washing cleanness of the clothes.

The quantity of the bulge structures 1 can be designed according to actual requirements; the quantity of the bulge structures 1 is 10 to 30 and preferably 15 to 20; and the bulge structures are respectively distributed along the hyperbolic curve and the sine curve.

The bulge structures 1 of the present disclosure are installed on the inner wall of the inner barrel of the washing machine by screws, the back of the thin wall structure is provided with screw studs 2 for installing the screws, and an anti-shrinkage structure of each screw stud is concealed in the corresponding bulge structure 1. The back of the screw stud always has a shrinkage problem, a conventional solution is to additionally install an anti-shrinkage structure, a specific anti-shrinkage structure is a volcanic vent structure produced on the screw stud, the so-called volcanic vent is to synchronously extend a hole edge of an outer cylindrical surface of the screw stud and a pin, and thus the plastic at the root of the screw stud is not so concentrated and is sufficiently cooled, thereby well preventing shrinkage marks. The anti-shrinkage structure of each screw stud is arranged inside the bulge structure in the present disclosure, thereby not only realizing the anti-shrinkage effect, but also guaranteeing the overall completeness and aesthetics of an appearance of the attached block structure. In order to prevent the clothes from being clamped between the attached block and the inner barrel during the washing, the thin wall structure of the attached block structure of the present disclosure and the inner barrel of the washing machine are seamlessly installed.

The above only describes embodiments of the present disclosure and is not intended to limit the present disclosure in any form.

What is claimed:

1. An attached block structure for an inner barrel of a washing machine, comprising: a thin wall structure, which is installed on an inner wall of the inner barrel of the washing machine; a series of bulge structures arranged on one side of the thin wall structure facing an interior of the inner barrel of the washing machine, the bulge structures being distributed along curves;

wherein the bulge structures are symmetrically distributed about a center of the thin wall structure;

wherein distribution curves of the bulge structures comprise a hyperbolic curve and a sine curve, and the hyperbolic curve is disposed at two sides of the sine curve;

wherein the sine curve is arranged along a diagonal line of the thin wall structure; a focal point of the hyperbolic curve is disposed on an X axis, one branch of the hyperbolic curve in −X axis direction is arranged at a left side of the sine curve, the other branch of the hyperbolic curve in +X axis direction is arranged at a right side of the sine curve, and an asymptotic line of the hyperbolic curve is the diagonal line of the thin wall structure provided with the sine curve, so that when the water flow rotates in the clockwise direction and in the counterclockwise direction, different directions of the acting force of the bulge structures are applied on the water flow to form a three-dimensional water flow.

2. The attached block structure for the inner barrel of the washing machine according to claim 1, wherein an upper part of the thin wall structure is installed near a top of the inner barrel, and a lower part of the thin wall structure is installed near a junction between a bottom of the inner barrel and a drum body.

3. The attached block structure for the inner barrel of the washing machine according to claim 2, wherein the thin wall structure is in a rectangular shape as a whole, a width is ⅕-⅔ of a length of the thin wall structure, and a thickness is 1/20-⅕ of the length of the thin wall structure; and a cross section of the thin wall structure is in an arc shape, and a lengthwise section of the thin wall structure is in a streamline shape.

4. The attached block structure for the inner barrel of the washing machine according to claim 1, wherein the bulge structures and the thin wall structure are integrally injection-molded, and each bulge structure is in a hemispherical shape.

5. The attached block structure for the inner barrel of the washing machine according to claim 1, wherein the quantity of the bulge structures is 10 to 30; and the bulge structures are respectively distributed along the hyperbolic curve and the sine curve.

6. The attached block structure for the inner barrel of the washing machine according to claim 5, wherein the quantity of the bulge structures is 15 to 20.

7. The attached block structure for the inner barrel of the washing machine according to claim 1, wherein the bulge structures are installed on the inner wall of the inner barrel of the washing machine by screws, a back of the thin wall structure is provided with screw studs for installing the screws, and an anti-shrinkage structure of each screw stud is concealed in the corresponding bulge structure.

8. The attached block structure for the inner barrel of the washing machine according to claim 1, wherein the thin wall structure and the inner barrel of the washing machine are seamlessly installed.

* * * * *